US011076240B2

(12) United States Patent
Hu et al.

(10) Patent No.: US 11,076,240 B2
(45) Date of Patent: Jul. 27, 2021

(54) SPEAKER

(71) Applicant: AAC Acoustic Technologies (Shenzhen) Co., Ltd., Shenzhen (CN)

(72) Inventors: Hongjian Hu, Shenzhen (CN); Shuai Li, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 16/699,144

(22) Filed: Nov. 29, 2019

(65) Prior Publication Data

US 2020/0186933 A1 Jun. 11, 2020

(30) Foreign Application Priority Data

Dec. 10, 2018 (CN) ..... 201822067640.0

(51) Int. Cl.

| | |
|---|---|
| ***H04R 25/00*** | (2006.01) |
| ***H04R 15/00*** | (2006.01) |
| ***H04R 7/16*** | (2006.01) |
| ***H04R 7/04*** | (2006.01) |
| ***H04R 1/28*** | (2006.01) |

(52) U.S. Cl.

CPC ..... *H04R 15/00* (2013.01); *H04R 1/2811* (2013.01); *H04R 7/04* (2013.01); *H04R 7/16* (2013.01)

(58) Field of Classification Search

CPC ..... H04R 9/06; H04R 9/025; H04R 2400/11; H04R 2400/07; H04R 9/043

See application file for complete search history.

(56) References Cited

U.S. PATENT DOCUMENTS

| | | | | |
|---|---|---|---|---|
| 9,813,821 | B1 * | 11/2017 | Song | H04R 9/025 |
| 10,003,887 | B2 * | 6/2018 | Linghu | H04R 9/04 |
| 10,250,989 | B1 * | 4/2019 | Xiao | H04R 31/003 |
| 10,284,959 | B2 * | 5/2019 | Xiao | H04R 9/06 |
| 10,820,107 | B2 * | 10/2020 | Feng | H04R 9/025 |
| 2009/0136065 | A1 * | 5/2009 | Yano | H04R 31/006 381/186 |

* cited by examiner

*Primary Examiner* — Phylesha Dabney
(74) *Attorney, Agent, or Firm* — W&G Law Group LLP

(57) ABSTRACT

The present invention discloses a speaker, which includes a basket, a vibration system fixed to the basket, and a magnetic circuit system arranged in the basket. The vibration system includes a first diaphragm fixed to the basket and a second diaphragm oppositely separated from the first diaphragm, the magnetic circuit system includes an upper clamping plate fixed to the basket, and the upper clamping plate is disposed separately from the second diaphragm. The upper clamping plate includes a fixing portion fixed to the basket, the upper clamping plate is provided with a step recessed towards the first diaphragm from one side of the upper clamping plate facing away from the first diaphragm, and the step is connected with the fixing portion.

6 Claims, 4 Drawing Sheets

A-A

B-B

C

SPEAKER

TECHNICAL FIELD

The present disclosure relates to electroacoustic conversion technologies, and more particularly, to a speaker.

BACKGROUND

With a continuously increased market demand, electronic devices such as mobile phones are gradually developing towards a direction of thinning with an increasing better sound quality, which requires acoustic devices in the mobile phones to become mini and thin with a high sound quality. As a core member of the speaker and other acoustic devices, requirements for acoustic performance of a diaphragm are improved accordingly.

A speaker in related technologies includes a basket, a vibration system fixed to the basket, and a magnetic circuit system arranged in the basket. The vibration system includes a first diaphragm fixed to the basket and a second diaphragm oppositely separated from the first diaphragm. The magnetic circuit system includes an upper clamping plate fixed to the basket, and the upper clamping plate is separated from the second diaphragm. In the structure of the speaker, one part of the upper clamping plate is fixed on the basket and another part of the upper clamping plate protrudes from an inner side of the basket. During a vibration process of the second diaphragm, the part of the upper clamping plate protruding from the inner side of the basket is located on a vibration path of the second diaphragm, and collides and interferes with the second diaphragm during the vibration process of the second diaphragm, so that quality of sound sent out by the speaker is impure.

Therefore, it is necessary to provide a new speaker to solve the above-mentioned problems.

DETAILED DESCRIPTION

The present disclosure is further explained hereinafter with reference to drawings and embodiments.

Figure 1:
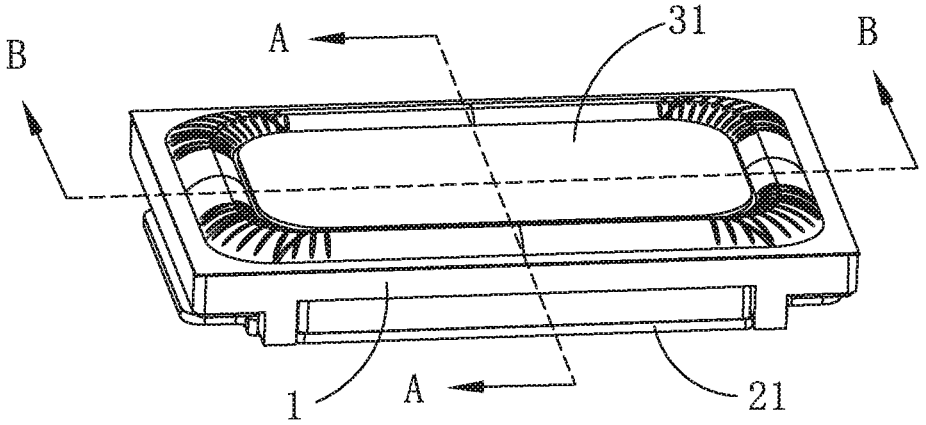
FIG. 1 is a perspective view of a speaker according to the present disclosure.
Figure 2:
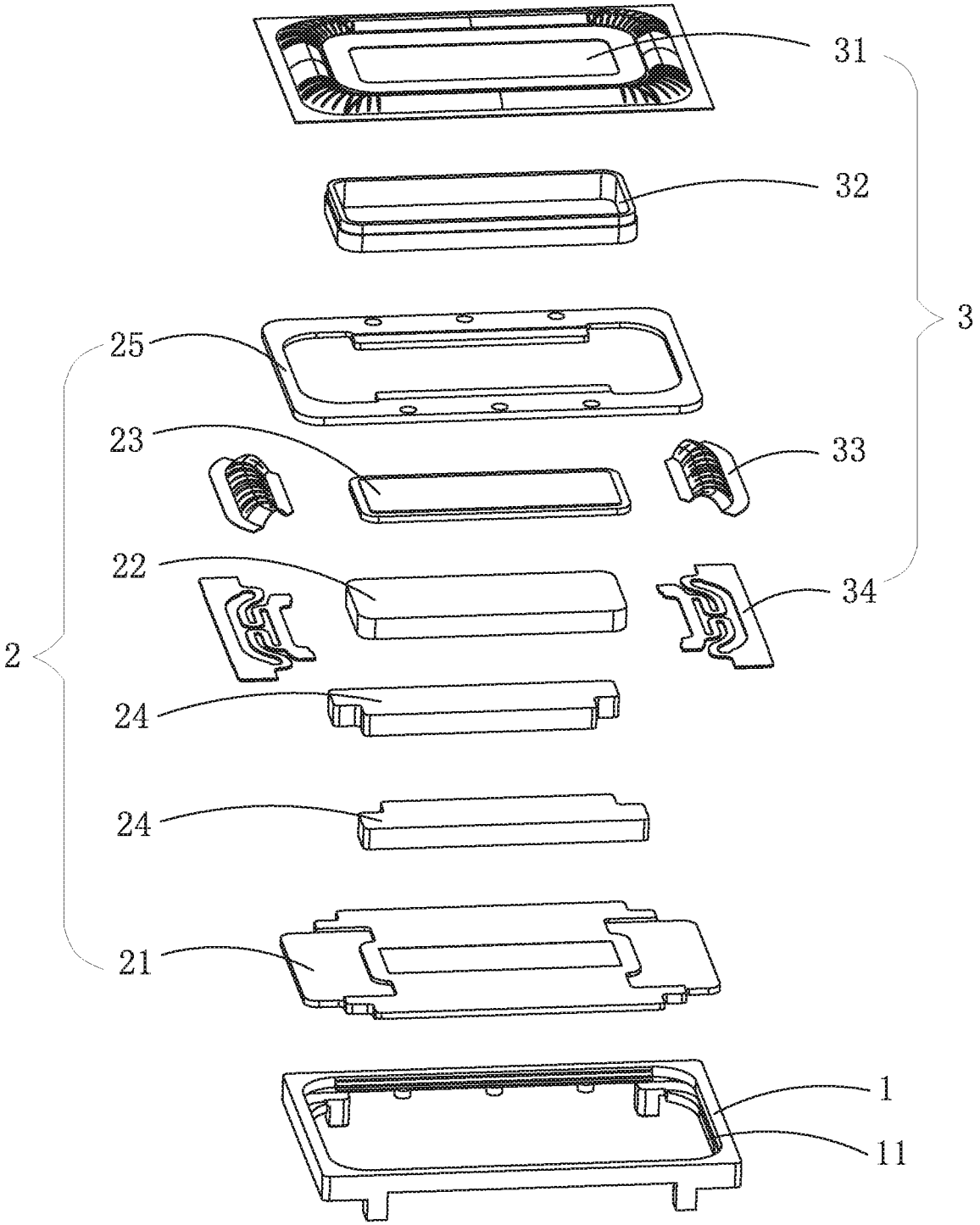
FIG. 2 is an exploded perspective view of the speaker according to the present disclosure.
Figure 3:
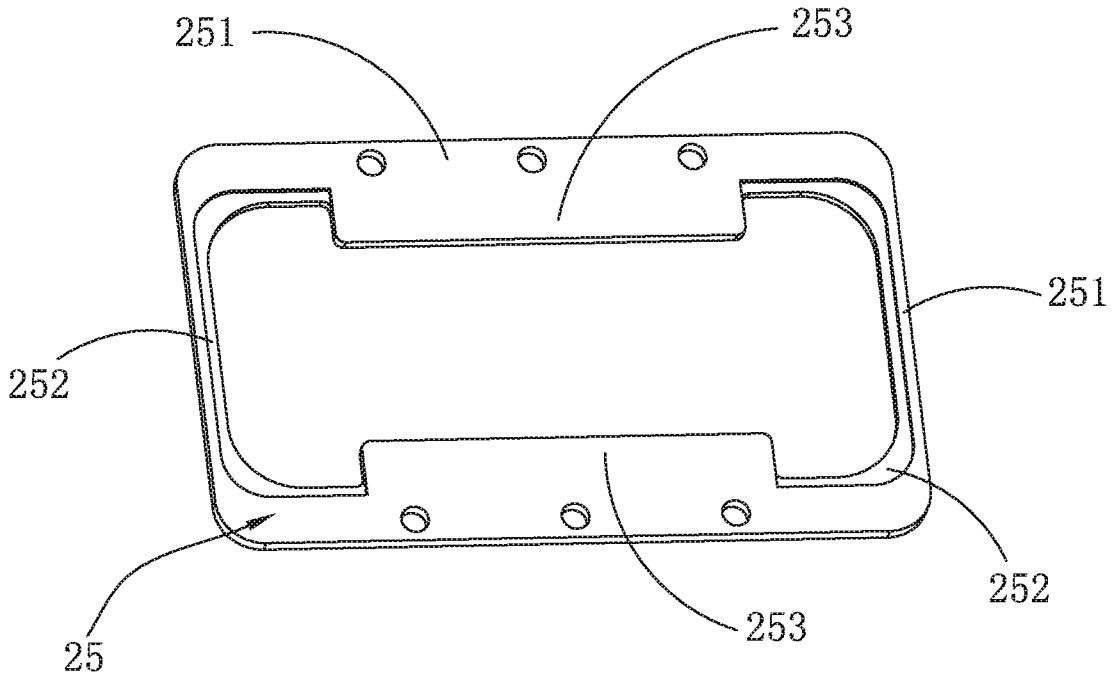
FIG. 3 is a perspective view of an upper clamping plate of the speaker according to the present disclosure.
Figure 4:
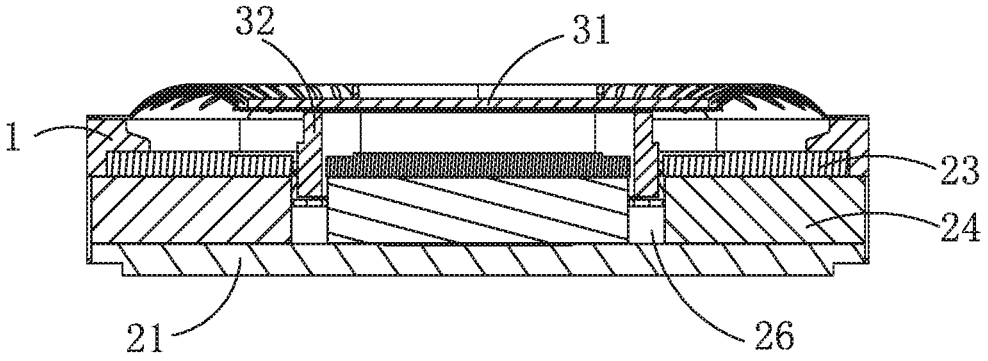
FIG. 4 is a sectional view along an A-A direction shown in FIG. 1.
Figure 5:
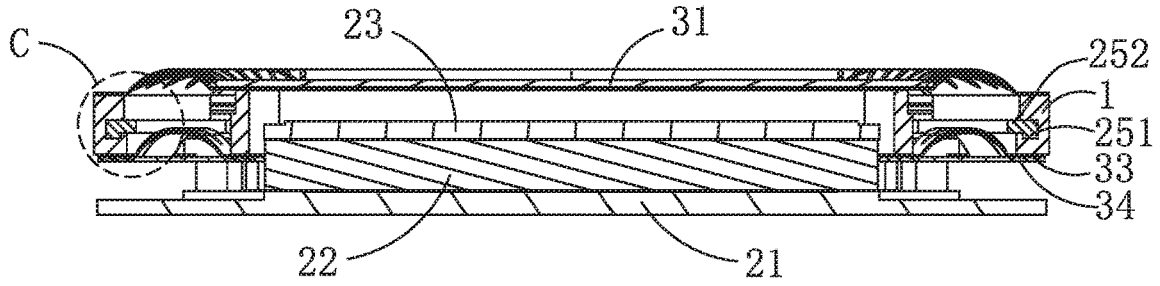
FIG. 5 is a sectional view along a B-B direction shown in FIG. 1.
Figure 6:
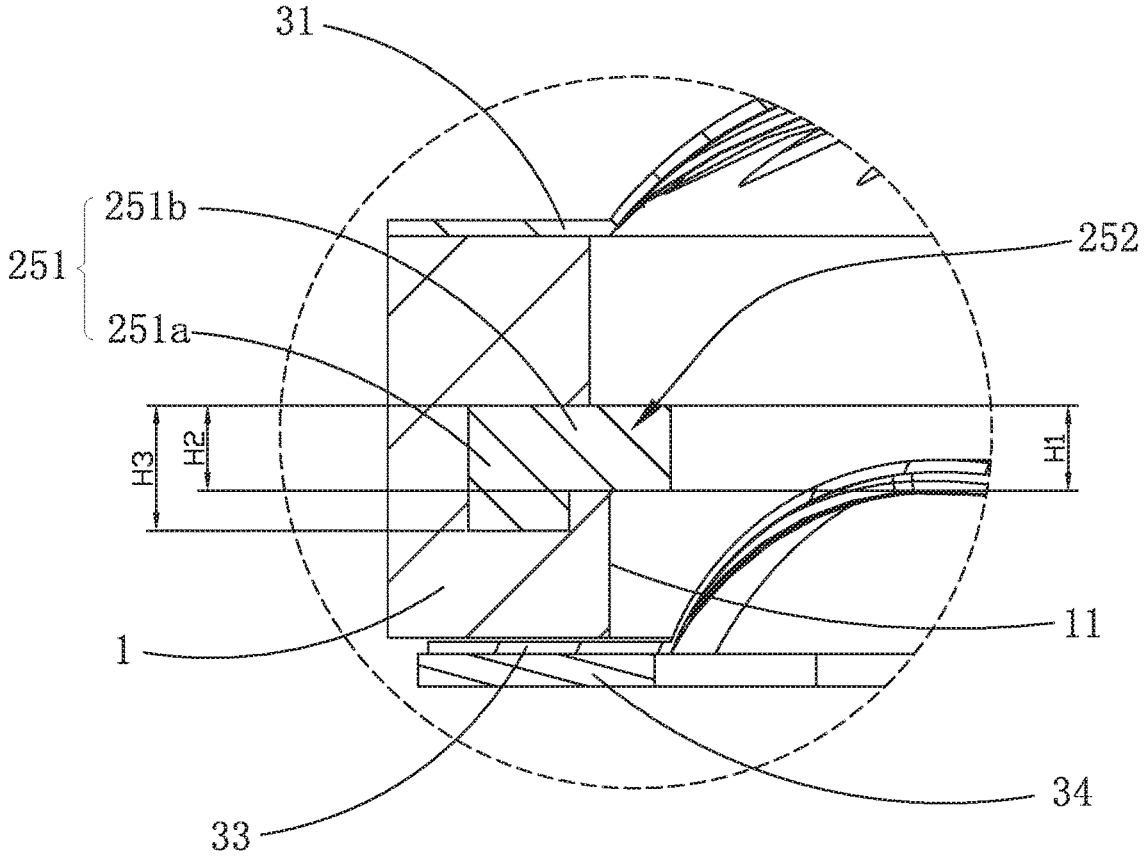
FIG. 6 is an enlarged view of a part C in FIG. 5.

FIGS. 1 to 6 show a structure of a speaker according to the present disclosure, which includes a basket 1, a magnetic circuit system 2 arranged in the basket 1 and a vibration system 3 fixed to the basket 1.

The magnetic circuit system 2 includes a magnetic bowl 21, a main magnetic steel 22 arranged in the magnetic bowl 21, a magnetic conduction plate 23 covered on the main magnetic steel 22, auxiliary magnetic steels 24 arranged on two opposite sides of the main magnetic steel 22 and an upper clamping plate 25 fixed to the basket 1. The main magnetic steel 22 and the auxiliary magnetic steels 24 are disposed separately from each other to form a magnetic gap 26.

The vibration system 3 includes a first diaphragm 31 fixed to the basket 1, a voice coil 32 connected to one side of the first diaphragm 31 close to the magnetic circuit system 2 and driving the first diaphragm 31 to vibrate and sound, a second diaphragm 33 fixed to the basket 1 and oppositely separated from the first diaphragm 31, and an elastic supporting member 34. One end of the second diaphragm 33 is fixed to the basket 1, and the other end of the second diaphragm is connected to one side of the voice coil 32 facing away from the first diaphragm 31. Further, two second diaphragms 33 are provided and symmetrically arranged at two opposite sides of the voice coil 32. One end of the elastic supporting member 34 is fixed to the basket 1, and the other end of the elastic supporting member is fixed to one side of the second diaphragm 33 facing away from the voice coil 32. The second diaphragm 33 and the elastic supporting member 34 are arranged opposite to each other and cooperate to suspend the voice coil 32 in the magnetic gap 26.

The upper clamping plate 25 includes a fixing portion 251 fixed to the basket 1, and a step 252 recessed towards the first diaphragm 31 from one side of the upper clamping plate 25 facing away from the first diaphragm 31. The step 252 is connected with the fixing portion 251. Further, the step 252 is located on a position of the upper clamping plate 25 directly facing the second diaphragm 33, and is oppositely separated from the second diaphragm 33. In this way, the second diaphragm 33 is avoided from colliding and interfering with the upper clamping plate 25 when vibrating, so as not to cause a problem of impure sound quality of the speaker.

Further, the fixing portion 251 includes a first embedding portion 251*a* embedded to the basket 1 and a second embedding portion 251*b* extending from the first embedding portion 251*a* towards the inside of the basket 1 and similarly embedded to the basket 1. A height H2 of the second embedding portion along a vibration direction of the vibration system 2 is less than a height H3 of the first embedding portion 251*a*. The basket 1 is provided with an inner side wall 11, and the step 252 is connected to the second embedding portion 251*b* and protrudes from the inner side wall 11 of the basket 1 to extend towards the inside of the basket 1.

Moreover, a height of the step 252 along a vibration direction of the vibration system 2 is no more than the height H2 of the second embedding portion 251*b*. Further, the height H1 of the step 252 is no more than the H3 of the first embedding portion 251*a*. By setting the above structure, the upper clamping plate is effectively avoided from colliding and interfering with the second diaphragm while an excellent magnetic conduction effect is ensured, so that a speaker with purer sound quality is obtained. In addition, a protruding portion 253 extending from the fixing portion 251 of the upper clamping plate 25 towards the inside of the basket 1 is arranged on a position of the upper clamping plate 25 corresponding to the auxiliary magnetic steel, and the protruding portion 253 is covered on the auxiliary magnetic steel 24. In this manner, the excellent magnetic conduction effect of the upper clamping plate is further ensured.

In conclusion, since the upper clamping plate is provided with the step recessed towards the first diaphragm from one side of the upper clamping plate facing away from the first diaphragm, in the vibrating process of the second diaphragm, the setting step on the upper clamping plate for avoiding the second diaphragm prevents the second diaphragm from colliding with the upper clamping plate when vibrating, and the upper clamping plate will not interfere with a vibration of the second diaphragm, thus avoiding an influence on a sound quality of the speaker, thereby obtaining a speaker with a purer sound quality.

The description above is merely the embodiments of the present disclosure, and it should be pointed out that those of ordinary skills in the art may make improvements without departing from the concept of the present disclosure, and all these improvements shall belong to the scope of protection of the present disclosure.

What is claimed is:

1. A speaker, comprising a basket, a vibration system fixed to the basket, and a magnetic circuit system arranged in the basket, wherein the vibration system comprises a first diaphragm fixed to the basket and a second diaphragm oppositely separated from the first diaphragm, the magnetic circuit system comprises an upper clamping plate fixed to the basket, and the upper clamping plate is disposed separately from the second diaphragm, wherein the upper clamping plate comprises a fixing portion fixed to the basket, the upper clamping plate is provided with a step recessed towards the first diaphragm from one side of the upper clamping plate facing away from the first diaphragm, and the step is located on a position of the upper clamping plate directly facing the second diaphragm and the step is connected with the fixing portion, wherein the fixing portion comprises a first embedding portion embedded to the basket and a second embedding portion extending from the first embedding portion towards the inside of the basket and embedded to the basket, the basket is provided with an inner side wall, and the step is connected to the second embedding portion and protrudes from the inner side wall to extend towards the inside of the basket.

2. The speaker according to claim 1, wherein a height of the step along a vibration direction of the vibration system is no more than a height of the second embedding portion.

3. The speaker according to claim 1, wherein a height of the step along a vibration direction of the vibration system is no more than a height of the first embedding portion.

4. The speaker according to claim 1, wherein a height of the second embedding portion along a vibration direction of the vibration system is less than a height of the first embedding portion.

5. The speaker according to claim 1, wherein the vibration system comprises a voice coil connected to one side of the first diaphragm close to the magnetic circuit system, and two second diaphragms are provided, and are symmetrically arranged on two opposite sides of the voice coil.

6. The speaker according to claim 1, wherein the magnetic circuit system comprises a magnetic bowl, a main magnetic steel arranged in the magnetic bowl and auxiliary magnetic steels arranged on two opposite sides of the main magnetic steel, a protruding portion extending from the fixing portion towards the inside of the basket is arranged on a position of the upper clamping plate corresponding to the auxiliary magnetic steel, and the protruding portion is covered on the auxiliary magnetic steel.

* * * * *